US005662238A

United States Patent [19]

Sarno

[11] Patent Number: 5,662,238

[45] Date of Patent: Sep. 2, 1997

[54] CONTAINER LINER HOLDER ASSEMBLY

[76] Inventor: Anthony J. Sarno, P.O. Box 1627, Lima, Ohio 45802

[21] Appl. No.: 643,003

[22] Filed: May 3, 1996

[51] Int. Cl.[6] ..... B65D 1/24

[52] U.S. Cl. ..... 220/404

[58] Field of Search ..... 220/404

[56] References Cited

U.S. PATENT DOCUMENTS

| | | | |
|---|---|---|---|
| 5,211,305 | 5/1993 | Horton | 220/404 |
| 5,275,490 | 1/1994 | Loebbert | 220/404 |
| 5,320,241 | 6/1994 | Evans | 220/404 |
| 5,476,187 | 12/1995 | Marisco | 220/404 |

*Primary Examiner*—Joseph M. Moy

[57] ABSTRACT

A container liner holder assembly adapted for use in association with a container having a hollow interior and an open top, an associated liner adapted to be positioned within the container, the assembly comprises a liner holder including at least one rail, the liner holder having a hollow central region and an upper surface, the liner holder including a plurality of supports extending therefrom, each support having an upper surface with an indentation, the liner holder being smaller than the open top of a container, in an operative orientation the supports of the liner holder being positioned upon the open top of a container; and a cap including at least one side member and a hollow central region, each side member being formed in an inverted U-shaped configuration with a vertical interior wall, a vertical exterior wall and an upper wall, in an operative orientation the cap being positioned over the liner holder and a container to secure a liner in place.

11 Claims, 3 Drawing Sheets

CONTAINER LINER HOLDER ASSEMBLY

BACKGROUND OF THE INVENTION

1. Field of the Invention

The present invention relates to a container liner holder assembly and more particularly pertains to neatly securing liners within the interior of a container.

2. Description of the Prior Art

The use of bag support devices is known in the prior art. More specifically, bag support devices heretofore devised and utilized for the purpose of supporting bags in an open orientation are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,558,800 to Isgar et al. discloses a bag support system.

U.S. Pat. No. to 4,723,740 to Courtemanche et al. discloses a support hook for plastic bags.

U.S. Pat. No. 5,065,891 to Casey discloses removable or fixed inner ring device for trash receptacle liners.

U.S. Pat. No. 4,917,263 to Korb discloses a household container assembly with adaptable lid for a plurality of bags.

U.S. Pat. No. Design 333,714 to Pizzo discloses a trash container liner retaining ring.

U.S. Pat. No. 4,196,880 to Hynes discloses a holder for plastic trash bag.

While these devices fulfill their respective, particular objective and requirements, the aforementioned patents do not describe a container liner holder assembly for neatly securing liners within the interior of a container.

In this respect, the container liner holder assembly according to the present invention substantially departs from the conventional concepts and designs of the prior art, and in doing so provides an apparatus primarily developed for the purpose of neatly securing liners within the interior of a container.

Therefore, it can be appreciated that there exists a continuing need for new and improved container liner holder assembly which can be used for neatly securing liners within the interior of a container. In this regard, the present invention substantially fulfills this need.

SUMMARY OF THE INVENTION

In the view of the foregoing disadvantages inherent in the known types of bag support devices now present in the prior art, the present invention provides an improved container liner holder assembly. As such, the general purpose of the present invention, which will be described subsequently in greater detail, is to provide a new and improved container liner holder assembly and method which has all the advantages of the prior art and none of the disadvantages.

To attain this, the present invention essentially comprises a new and improved container liner holder assembly comprising, in combination: a container formed in a generally rectangular configuration with two wide upstanding side walls and two narrow upstanding sidewalls, each side wall having an upper edge, the container having a floor, an open top, an essentially hollow interior and four corners; a liner holder including two parallel short rails and two parallel long rails arranged in a generally rectangular configuration, the liner holder having a hollow central region, an upper surface and four corners, each corner of the liner holder including a corner support extending therefrom at about a forty five degree angle with respect to the short and long rails, each corner support being formed in a generally rectangular configuration with a rounded outboard end, each corner support having an upper surface with a centrally positioned semicircular indentation, the liner holder having a smaller length and width than the open top of the container, in an operative orientation the corner supports of the liner holder being positioned upon corners of the container; a liner fabricated of plastic and adapted to fit within the hollow interior of the container, the liner having a greater vertical height than the container, the liner having an upper edge, in an operative orientation the liner being placed within the container with the upper edge of the liner being positioned through the liner holder, the upper edge being folded over the upper surface of the liner holder and positioned within the hollow interior of the container adjacent the side walls; and a cap including two parallel short side members and two parallel long side members arranged in a generally rectangular configuration, the cap having a hollow central region and four corners, each side member being formed in an inverted U-shaped configuration with a vertical interior wall, a vertical exterior wall and an upper wall, the upper wall including a flat lower surface and a generally semicircular shaped raised upper surface, the lower surface including a plurality of generally oval shaped prongs positioned therealong, in an operative orientation the cap being positioned over the liner holder and upper edge of the container, the prongs engaging the liner adjacent its upper edge to secure the liner in place against the rails of the liner holder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container liner holder assembly which has all the advantages of the prior art bag support devices and none of the disadvantages.

It is another object of the present invention to provide a new and improved container liner holder assembly which may be easily and efficiently manufactured and marketed.

It is a further object of the present invention to provide a new and improved container liner holder assembly which is of durable and reliable construction.

An even further object of the present invention is to provide a new and improved container liner holder assembly which is susceptible of a low cost of manufacture with regard to both materials and labor, and which accordingly is then susceptible of low prices of sale to the consuming public, thereby making such a container liner holder assembly economically available to the buying public.

Still yet another object of the present invention is to provide a new and improved container liner holder assembly which provides in the apparatuses and methods of the prior art some of the advantages thereof, while simultaneously overcoming some of the disadvantages normally associated therewith.

Even still another object of the present invention is to provide a new and improved container liner holder assembly for neatly securing liners within the interior of a container.

Lastly, it is an object of the present invention to provide a new and improved container liner holder assembly adapted for use in association with a container having a hollow interior and an open top, an associated liner adapted to be positioned within the container, the assembly comprises a liner holder including at least one rail, the liner holder having a hollow central region and an upper surface, the liner holder including a plurality of supports extending therefrom, each support having an upper surface with an indentation, the liner holder being smaller than the open top of a container, in an operative orientation the supports of the liner holder being positioned upon the open top of a container; and a cap including at least one side member and a hollow central region, each side member being formed in an inverted U-shaped configuration with a vertical interior wall, a vertical exterior wall and an upper wall, in an operative orientation the cap being positioned over the liner holder and a container to secure a liner in place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
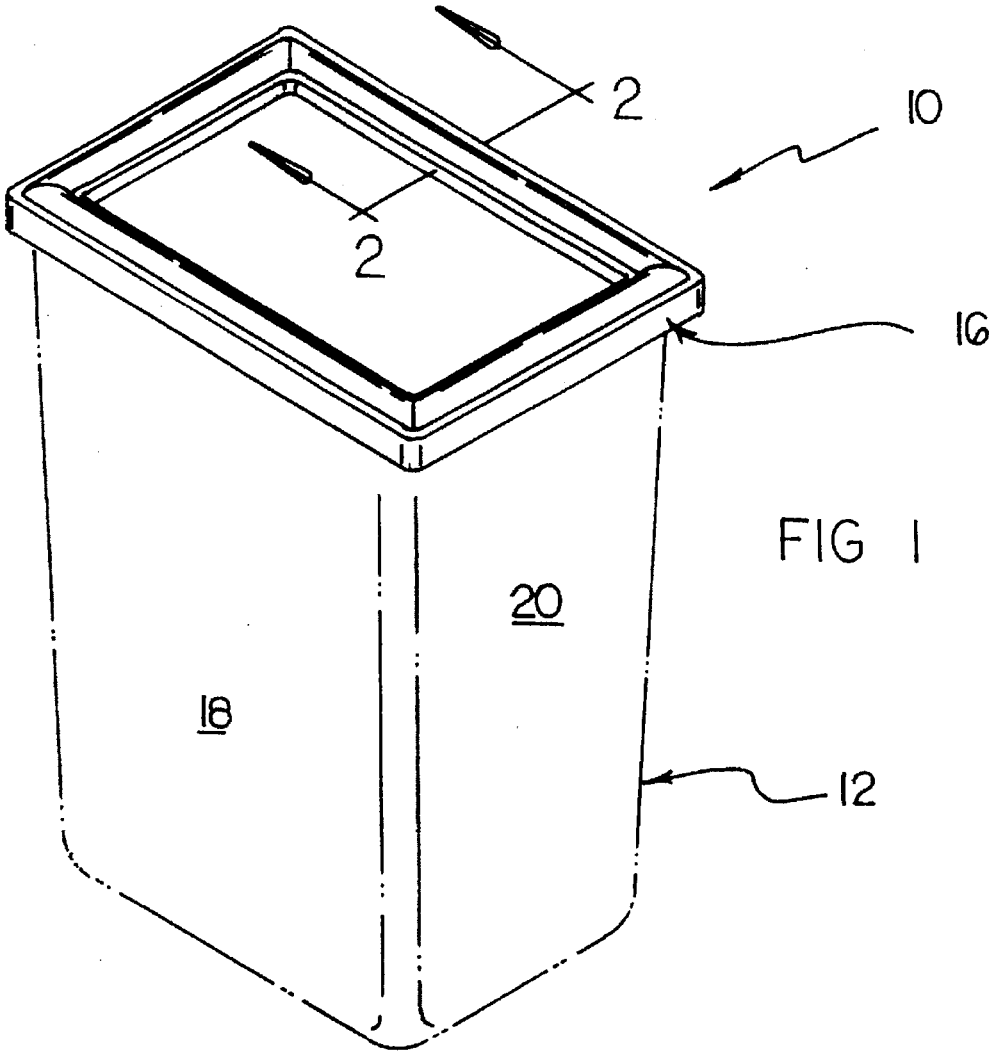
FIG. 1 is a perspective view of the preferred embodiment of the container liner holder assembly constructed in accordance with the principles of the present invention.

With reference now to the drawings, and in particular, to FIG. 1 thereof, the preferred embodiment of the new and improved container liner holder assembly embodying the principles and concepts of the present invention and generally designated by the reference number 10 will be described.

Specifically, it will be noted in the various Figures that the device relates to a container liner holder assembly for neatly securing liners within the interior of a container. In its broadest context, the device consists of a container 12, a liner holder 14 and a cap 16. Such components are individually configured and correlated with respect to each other so as to attain the desired objective.

The container 12 is formed in a generally rectangular configuration with two wide upstanding side walls 18 and two narrow upstanding sidewalls 20. Each side wall has an upper edge 22. The container has a floor and an open top. The container further includes an essentially hollow interior and four corners 24. In the preferred embodiment of the apparatus the container is fabricated of plastic. In alternate embodiments the container is fabricated of one or more of the following materials: steel, aluminum, wood. In various embodiments of the apparatus the container is formed in different shapes and sizes to accommodate different uses. Such uses include: a wastebasket, garbage pail, garbage can, or recycling bin. The container could be oval, round, or triangular. In alternate embodiments of the apparatus a container is not included. Rather, the liner holder and cap are utilized in association with an existing container and liner. Note FIG. 1.

Figure 2:
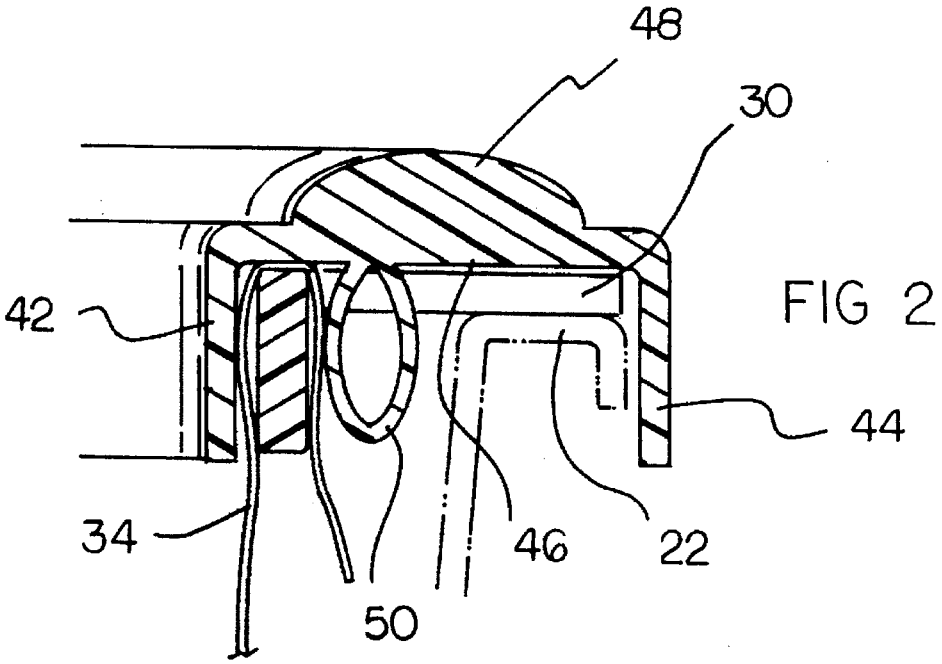
FIG. 2 is cross sectional view of the cap taken along section line 2—2 of FIG. 1.
Figure 3:
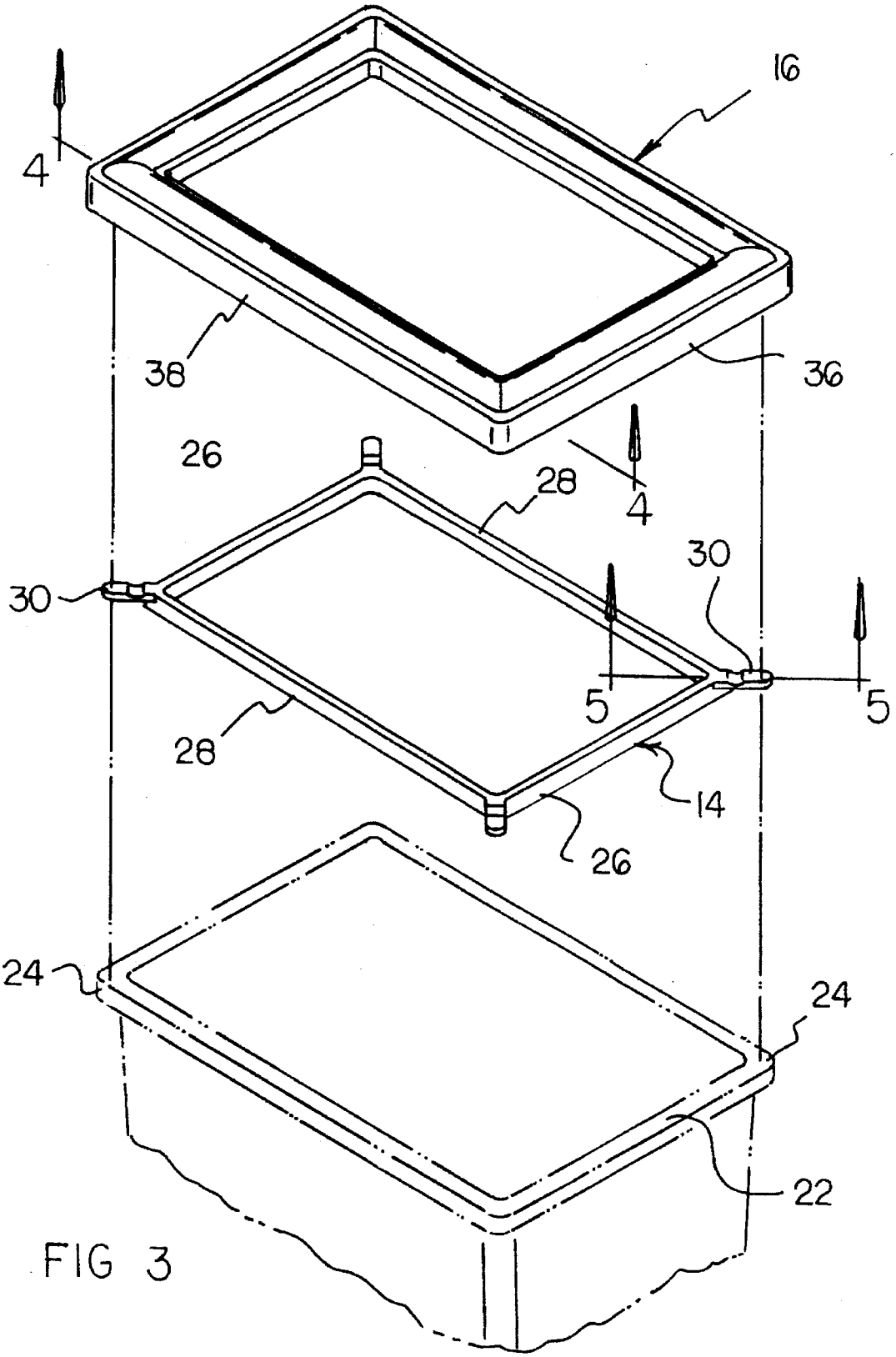
FIG. 3 is a separated perspective view illustrating the relative positioning of the cap, liner holder and container.
Figure 5:
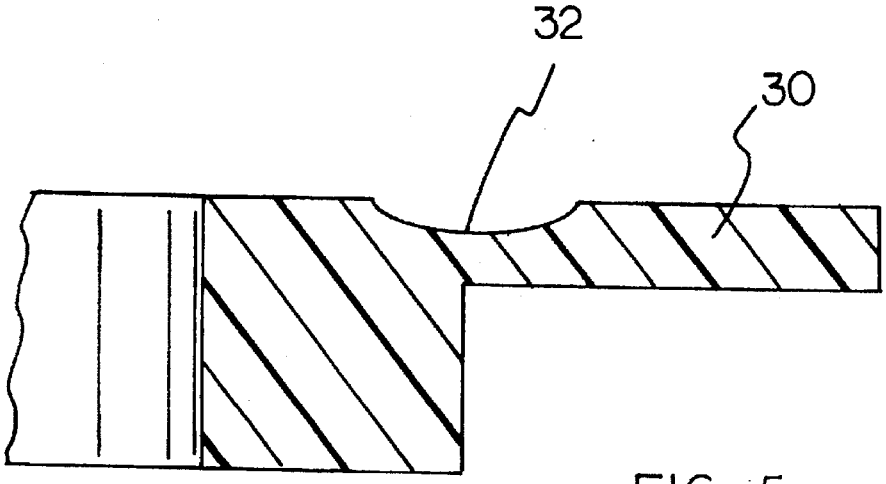
FIG. 5 is a cross sectional view of a corner support taken along section line 5—5 of FIG. 3.

The liner holder 14 includes two parallel short rails 26 and two parallel long rails 28 which are arranged in a generally rectangular configuration. The liner holder has a hollow central region, an upper surface and four corners. Each corner of the liner holder forms a ninety degree angle. Each corner includes a corner support 30 extending from it at about a forty five degree angle with respect to the short and long rails. Each corner support is formed in a generally rectangular configuration with a rounded outboard end. In the preferred embodiment each corner support is between one and one and one half inches in length. Each corner support has an upper surface with a centrally positioned semicircular indentation 32. The liner holder has a smaller length and width than the open top of the container. In an operative orientation the corner supports 30 of the liner holder are positioned upon corners of the container. This configuration provides evenly distributed support to the liner holder when suspended within the open top of the container. The length of the corner supports provide the necessary clearance area to tuck excess liner between the liner holder and inner surface of the sidewalls of the container. In an assembled orientation the interior vertical wall of the cap is positioned within the indentations 32 in the corner supports to allow the cap to lie flat. In an alternate embodiment of the apparatus the liner holder is formed integrally with the upper edge of the container. In varying embodiments of the apparatus the liner holder is formed as a closed top. Note FIGS. 2, 3 and 5.

A liner 34 is fabricated of plastic and adapted to fit within the hollow interior of the container. The liner has a greater vertical height than the container. The liner has an upper edge which extends above the upper edge of the side walls of the container in a fully extended orientation. In an operative orientation the liner is placed within the container. The upper edge of the liner is positioned through the liner holder. The upper edge is folded over the upper surface of the liner holder and is tucked within the hollow interior of the container adjacent the side walls. In this orientation the upper edge of the liner and any excess liner is neatly positioned between the rails of the liner holder and the inner surface of the side walls of the container. Note FIGS. 1 and 2.

Figure 4:
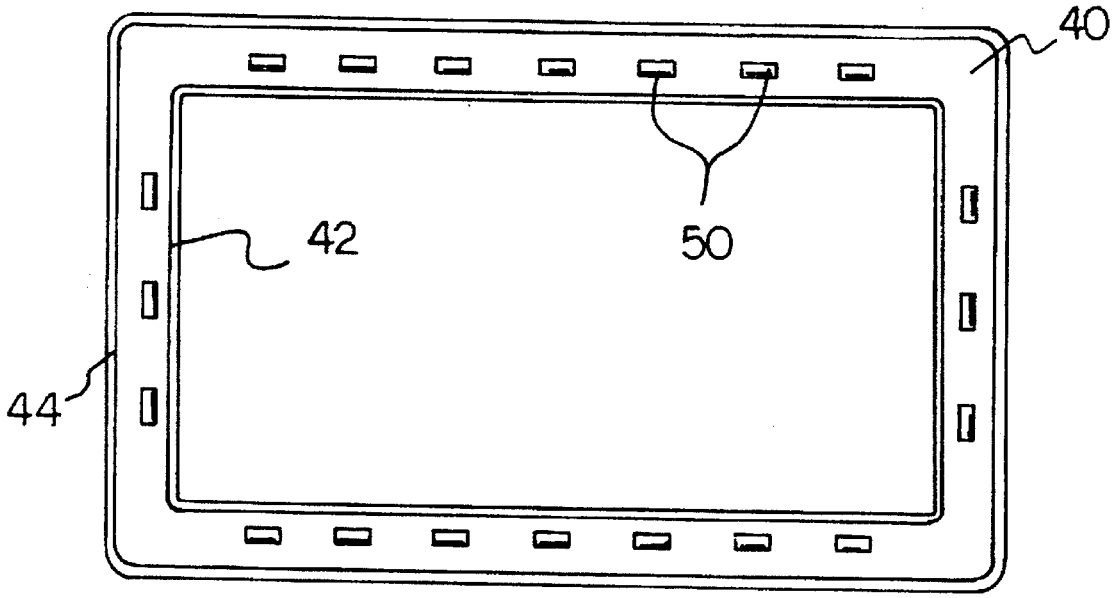
FIG. 4 is a bottom plan view of the cap taken along section line 4—4 of FIG. 3.

A cap 16 includes two parallel short side members 36 and two parallel long side members 38 arranged in a generally rectangular configuration. The cap has a hollow central region and four corners 40. Each side member is formed in an inverted U-shaped configuration with a vertical interior wall 42, a vertical exterior wall 44 and an upper wall. The upper wall includes a flat lower surface 46 and a generally semicircular shaped raised upper surface 48. The width of the upper wall is sufficient to cover the rails of the liner holder, as well as the upper edge of the container. The lower surface of the upper wall 46 includes a plurality of generally oval shaped prongs 50 positioned therealong. The prongs extend downwardly from the upper wall in a generally vertical orientation. The prongs are absent from the corners 40 of the cap. In an operative orientation the cap is positioned over the liner holder and upper edge of the container. The prongs 50 engage the liner 34 adjacent its upper edge to secure the liner in place against the rails of the liner holder. This configuration prevents the liner from falling down inside the container, thereby eliminating messy cleanups. The cap and liner holder are easily removable when the liner is full. The cap and liner holder can be fabricated in a plurality of different colors to accommodate varying decors. Note FIGS. 2–4.

In an alternate embodiment of the apparatus the liner holder includes a central divider. The central divider allows a user to support two separate liners in one container for the purpose of separating recyclable materials.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved container liner holder assembly comprising, in combination:

a container formed in a generally rectangular configuration with two wide upstanding side walls and two narrow upstanding sidewalls, each side wall having an upper edge, the container having a floor, an open top, an essentially hollow interior and four corners;

a liner holder including two parallel short rails and two parallel long rails arranged in a generally rectangular configuration, the liner holder having a hollow central region, an upper surface and four corners, each corner of the liner holder including a corner support extending therefrom at about a forty five degree angle with respect to the short and long rails, each corner support being formed in a generally rectangular configuration with a rounded outboard end, each corner support having an upper surface with a centrally positioned semicircular indentation, the liner holder having a smaller length and width than the open top of the container, in an operative orientation the corner supports of the liner holder being positioned upon corners of the container;

a liner fabricated of plastic and adapted to fit within the hollow interior of the container, the liner having a greater vertical height than the container, the liner having an upper edge, in an operative orientation the liner being placed within the container with the upper edge of the liner being positioned through the liner holder, the upper edge being folded over the upper surface of the liner holder and positioned within the hollow interior of the container adjacent the side walls; and a cap including two parallel short side members and two parallel long side members arranged in a generally rectangular configuration, the cap having a hollow central region and four corners, each side member being formed in an inverted U-shaped configuration with a vertical interior wall, a vertical exterior wall and an upper wall, the upper wall including a flat lower surface and a generally semicircular shaped raised upper surface, the lower surface including a plurality of generally oval shaped prongs positioned therealong, in an operative orientation the cap being positioned over the liner holder and upper edge of the container, the prongs engaging the liner adjacent its upper edge to secure the liner in place against the rails of the liner holder.

2. A container liner holder assembly adapted for use in association with a container having a hollow interior and an open top, an associated liner adapted to be positioned within the container, the assembly comprising:

a liner holder including at least one rail, the liner holder having a hollow central region and an upper surface, the liner holder including a plurality of supports extending therefrom, each support having an upper surface with an indentation, the liner holder being smaller than the open top of a container, in an operative orientation the supports of the liner holder being positioned upon the open top of a container; and a cap including at least one side member and a hollow central region, each side member being formed in an inverted U-shaped configuration with a vertical interior wall, a vertical exterior wall and an upper wall, in an operative orientation the cap being positioned over the liner holder and a container to secure a liner in place.

3. The container liner holder assembly as set forth in claim 2 wherein the upper wall of the cap has a flat lower surface including a plurality of generally oval shaped prongs positioned therealong.

4. The container liner holder assembly as set forth in claim 2 wherein the upper wall of the cap has a generally semicircular shaped raised upper surface.

5. The container liner holder assembly as set forth in claim 3 and further including:

a container having an essentially hollow interior and an open top.

6. The container liner holder assembly as set forth in claim 5 wherein the container is formed in a generally rectangular configuration with two wide upstanding side walls and two narrow upstanding sidewalls, each side wall having an upper edge, the container having a floor, an open top, an essentially hollow interior and four corners.

7. The container liner holder assembly as set forth in claim 6 and further including:

a liner fabricated of plastic and adapted to fit within the hollow interior of the container, the liner having a greater vertical height than the container, the liner having an upper edge, in an operative orientation the liner being placed within the container with the upper edge of the liner being positioned through the liner holder, the upper edge being folded over the upper surface of the liner holder and positioned within the hollow interior of the container adjacent the side walls.

8. The container liner holder assembly as set forth in claim 5 wherein the container is a wastebasket.

9. The container liner holder assembly as set forth in claim 5 wherein the container is a garbage pail.

10. The container liner holder assembly as set forth in claim 5 wherein the container is a recycling bin.

11. The container liner holder assembly as set forth in claim 5 wherein the liner holder is formed integrally with the open top of the container.

* * * * *